US007361822B1

(12) United States Patent
Hsieh

(10) Patent No.: US 7,361,822 B1
(45) Date of Patent: Apr. 22, 2008

(54) PLUG ASSEMBLY FOR A XYLOPHONE RESONATOR

(75) Inventor: Wu-Hong Hsieh, Lu Chou (TW)

(73) Assignee: K.H.S. Musical Instrument Co., Ltd. (TW)

( * ) Notice: Subject to any disclaimer, the term of this patent is extended or adjusted under 35 U.S.C. 154(b) by 0 days.

(21) Appl. No.: 11/634,634

(22) Filed: Dec. 6, 2006

(51) Int. Cl.
*G10D 13/08* (2006.01)

(52) U.S. Cl. ..... 84/410; 84/402

(58) Field of Classification Search ..... 84/402, 84/410

See application file for complete search history.

(56) References Cited

U.S. PATENT DOCUMENTS

| | | | | | |
|---|---|---|---|---|---|
| 500,433 | A * | 6/1893 | Schubert | 84/330 |
| 520,344 | A * | 5/1894 | Weigle | 84/349 |
| 1,173,507 | A * | 2/1916 | Haskell | 84/170 |
| 2,085,363 | A * | 6/1937 | Hultsch | 84/403 |
| 2,414,656 | A * | 1/1947 | Miller | 84/405 |
| 3,766,683 | A * | 10/1973 | Vennola | 446/126 |
| 4,240,320 | A * | 12/1980 | Pellerite | 84/384 |
| 4,570,525 | A * | 2/1986 | Suzuki | 84/410 |
| 4,770,080 | A * | 9/1988 | Jivoin | 84/330 |
| 4,941,386 | A * | 7/1990 | Stevens | 84/410 |
| 5,189,236 | A * | 2/1993 | Stevens | 84/410 |
| 6,660,919 | B2 * | 12/2003 | Lim | 84/384 |
| 6,891,096 | B2 * | 5/2005 | Guay | 84/331 |

* cited by examiner

*Primary Examiner*—Lincoln Donovan
*Assistant Examiner*—Robert W Horn
(74) *Attorney, Agent, or Firm*—Jackson Walker, LLP

(57) ABSTRACT

A plug assembly for a xylophone resonator includes a cover adapted to be mounted on the xylophone resonator to close an opening of the xylophone resonator, an annular disk adapted to be received inside the xylophone resonator and a threaded rod having a threaded bottom end extending through the cover to securely and threadingly connect to the annular disk and a threaded top end engaging with a knob. The threaded rod is selectively movable relative to the cover via the control of a controlling nut such that position of the annular disk inside the xylophone resonator is adjusted.

10 Claims, 5 Drawing Sheets

PLUG ASSEMBLY FOR A XYLOPHONE RESONATOR

BACKGROUND OF THE INVENTION

1. Field of the Invention

The present invention relates to a plug assembly, and more particularly to a plug assembly for a xylophone resonator to allow a user to easily adjust positions of an annular disk to accomplish the objective of tune adjustment.

2. Description of the Prior Art

There are generally two types of resonators, one is a cylindrical tube extending directly downward from a xylophone and the other is a cylindrical tube extending downward from the xylophone and having a bend formed on the cylindrical tube. The former is for a xylophone of a smaller scale and the latter is for a xylophone of a larger scale. In the past, each resonator needs an annular disk inside the resonator to adjust the tune of each key of the xylophone. As the differences in humidity, temperature and air density in places of performance, the tune of the keys changes. Then it is time for the user to adjust the positions of the annular disks in the resonators.

To those that have vertical cylindrical tubes, the user is able to easily to accomplish the objective of changing the positions of the annular disk. However, to those having bending cylindrical tubes, first the user is going to have difficulties trying to reach the annular disks. Then the user will have a hard time moving the annular disk inside each of the resonators. This is because each bending cylindrical tube has an opening located inside a limited space, which poses great difficulties to the user from reaching the annular disks. As a result, it takes a great deal of time for the user to accomplish the objective of tuning for the xylophone of a large scale.

To overcome the shortcomings, the present invention tends to provide an improved plug assembly to mitigate the aforementioned problems.

SUMMARY OF THE INVENTION

The primary objective of the present invention is to provide a plug assembly for each of the resonators of a xylophone such that the user is able to easily changing the positions of the annular disks inside the xylophone.

In one aspect of the present invention, the plug assembly of the present invention has a cover firmly attachable to a resonator opening, a threaded rod extending through the cover and having a bottom end which is threadingly connected to the annular disk and a top end which is threadingly connected to a knob. A clamping element is selectively and firmly engaged to an outer periphery of the threaded rod via a controlling nut. Therefore, when the controlling nut is loosened, the threaded rod is able to move relative to the clamping element and thus the objective of changing the position of the annular disk is accomplished.

Other objects, advantages and novel features of the invention will become more apparent from the following detailed description when taken in conjunction with the accompanying drawings.

DETAILED DESCRIPTION OF THE PREFERRED EMBODIMENT

Figure 1:
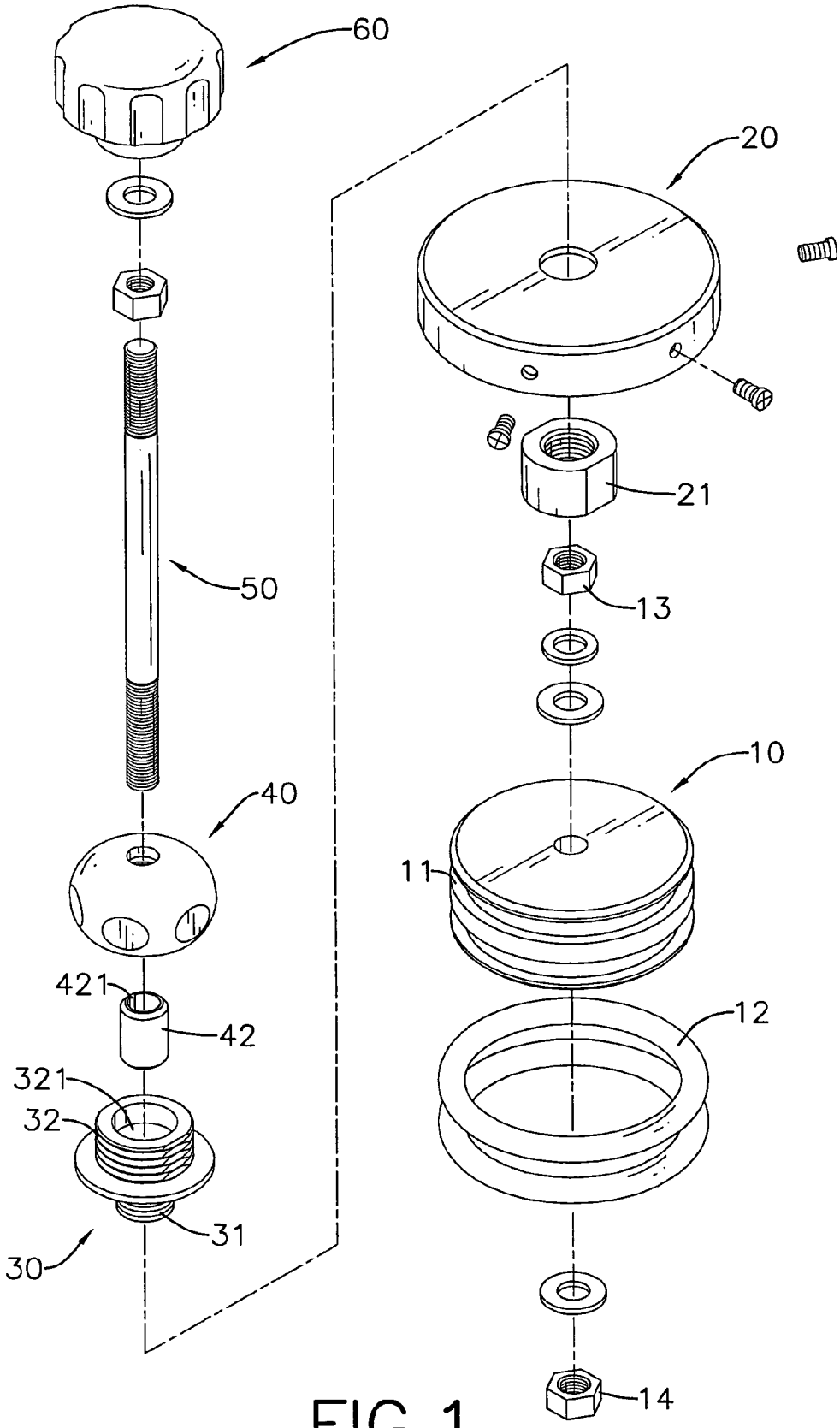
FIG. 1 is an exploded perspective view of the plug assembly of the present invention.

With reference to FIG. 1, it is noted that the securing device in accordance with the present invention includes an annular disk (10), a cover (20), a joint (30), a controlling nut (40), a threaded rod (50) and a knob (60).

The annular disk (10) has annular grooves (11) defined in a side face thereof so as to receive therein sealing rings (12). A top securing nut (13) and a bottom securing nut (14) are respectively provided to a top side and a bottom side of the annular disk (10).

The cover (20) is adapted to be mounted on an opening of a resonator to literally close the opening of the resonator. Multiple securing bolts are employed to secure the engagement between the cover (20) and the periphery defining the opening.

The joint (30) has a first threaded connection portion (31) extending through the cover (30) to threadingly connect to a cover securing nut (21) and a second threaded connection portion (32) integrally formed with the first threaded connection portion (31) and extending upward for connection with the controlling nut (30) with a clamping element (42) sandwiched between the joint (30) and the controlling nut (40). It is noted that the second threaded connection portion (32) has a recessed supporting face (321) longitudinally formed inside the second threaded connection portion (32) and the clamping element (42) is able to be received inside the supporting face (321) without falling into the first threaded connection portion (31).

The threaded rod (50) has a threading formed on two opposite ends thereof. The bottom end of the threaded rod (50) extends through the controlling nut (40), the clamping element (42), the joint (30), the cover (20), the cover securing nut (21), the top securing nut (13) and the annular disk (10) to threadingly connect to the bottom securing nut (14). The top end of the threaded rod (50) is threadingly connected to the knob (60).

Figure 2:
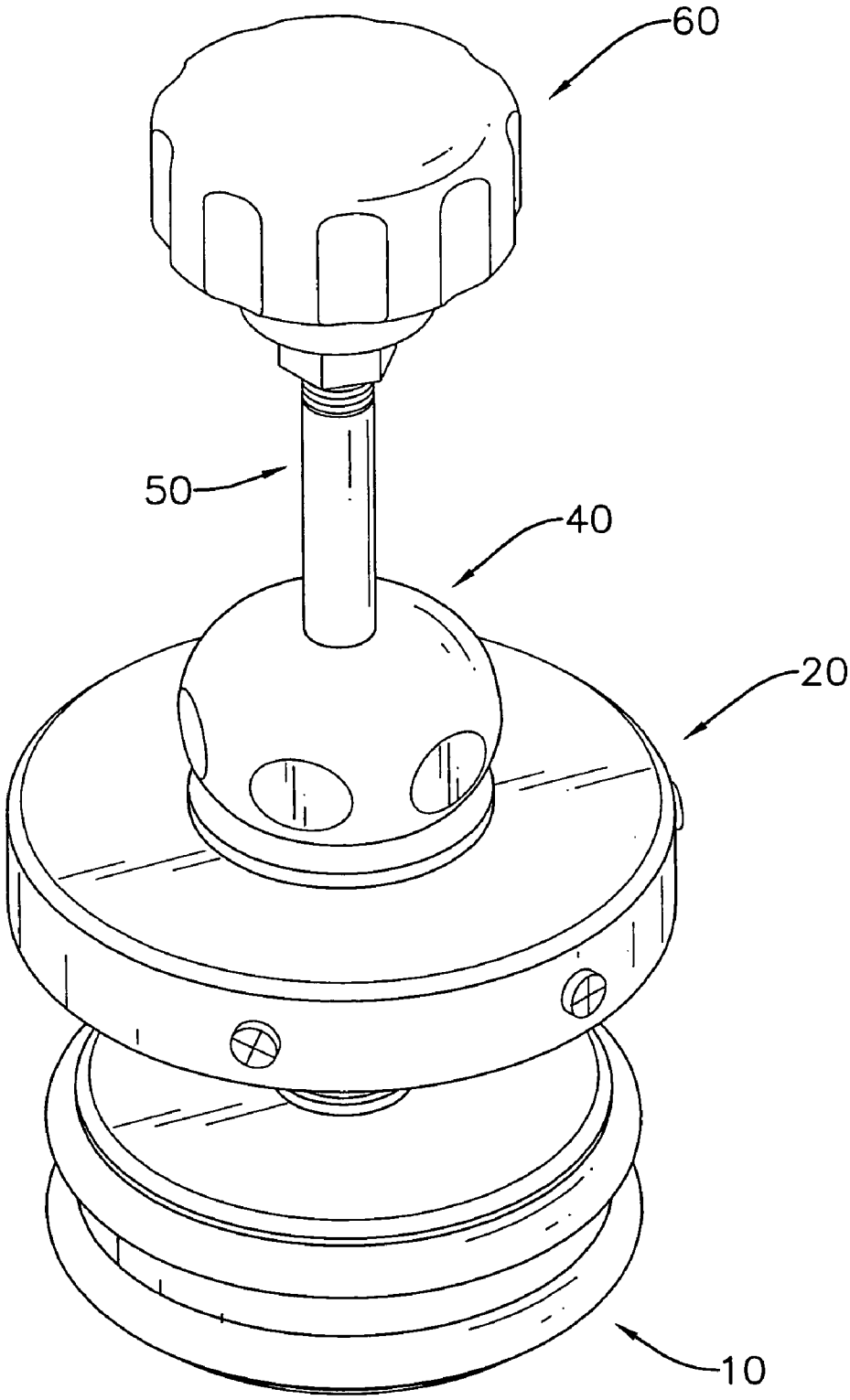
FIG. 2 is a perspective view of the plug assembly in assembly.
Figure 3:
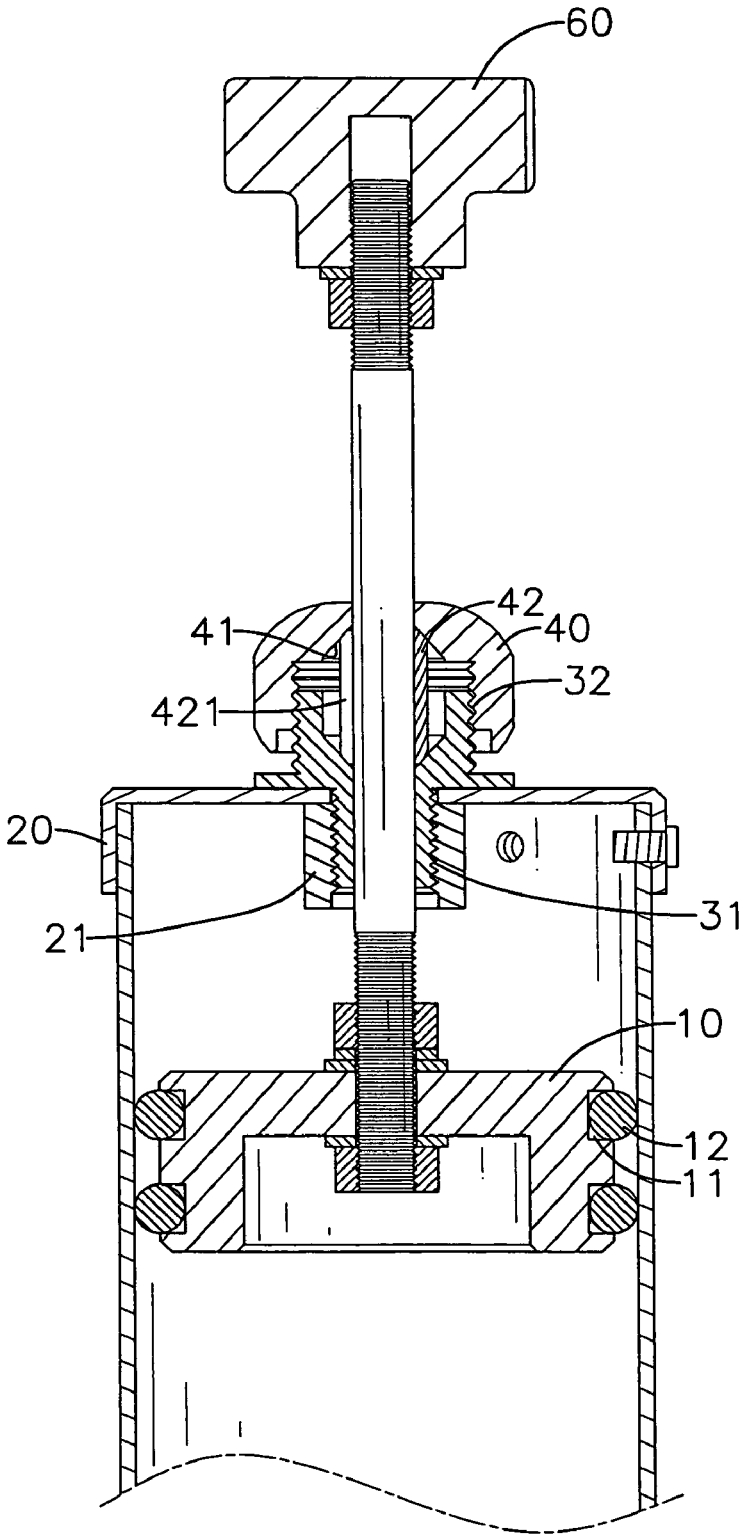
FIG. 3 is a cross sectional view taken from line 3-3 in FIG. 2.

With reference to FIGS. 2 and 3, it is noted that when the plug assembly of the present invention is assembled, the knob (60) is firstly and threadingly connected to the top end of the threaded rod (50). The bottom end of the threaded rod (50) is extended through the controlling nut (40), the clamping element (42), the joint (30), the cover (20), the cover securing nut (21), the top securing nut (13) and the annular disk (10) to threadingly connect to the bottom securing nut (14).

It is noted that with the provision of the top securing nut (13) and the bottom securing nut (14), the position of the annular disk (10) is changeable relative to the bottom end of the threaded rod (50). Also, a connection nut provided to the top end of the threaded rod (50) helps change the position of the knob (60) relative to the top end of the threaded rod (50). After the first threaded connection portion (31) is threadingly connected to the cover securing nut (21) and the second threaded connection portion (32) is threadingly connected to the controlling nut (40) with the clamping element (42) received between the joint (30) and the controlling nut (40), a conical face (41) formed inside the controlling nut (40) is able to abut a top end of the clamping element (42) which has a longitudinally formed slit (421) defined through a side face of the clamping element (42). Therefore, when the conical face (41) keeps on abutting the top end of the clamping element (42), the clamping element (42) engages with the outer periphery of the threaded rod (50). Also, the larger the force of the controlling nut (40) applies to the clamping element (42), the tighter the clamping element (42) engages with the outer periphery of the threaded rod (50), which stops the threaded rod (50) from movement relative to the cover (20).

Figure 4:
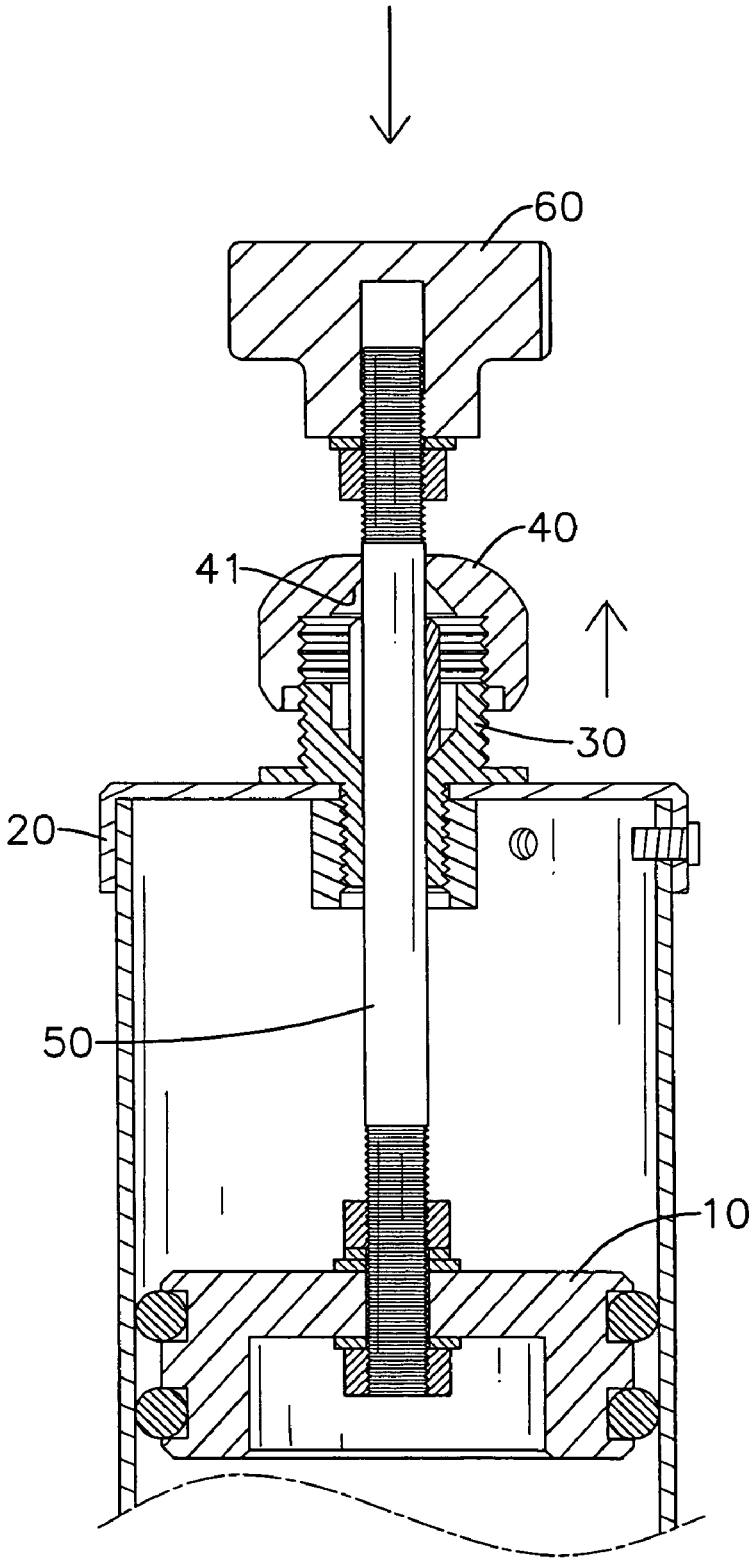
FIG. 4 is a schematic view showing that the position of the annular disk is changeable once the controlling nut is loosened.

With reference to FIG. 4, it is noted that after the cover (20) is securely mounted on the resonator to substantially close the opening of the resonator, if the controlling nut (40) is loosened to release the abutment of the conical face (41) to the top end of the clamping element (42), the threaded rod (50) is able to move up and down relative to the cover (20). Because the annular disk (10) is securely connected to the bottom end of the threaded rod (50), while the threaded rod (50) is moveable relative to the cover (20), the position of the annular disk (10) inside the resonator is changed.

Figure 5:
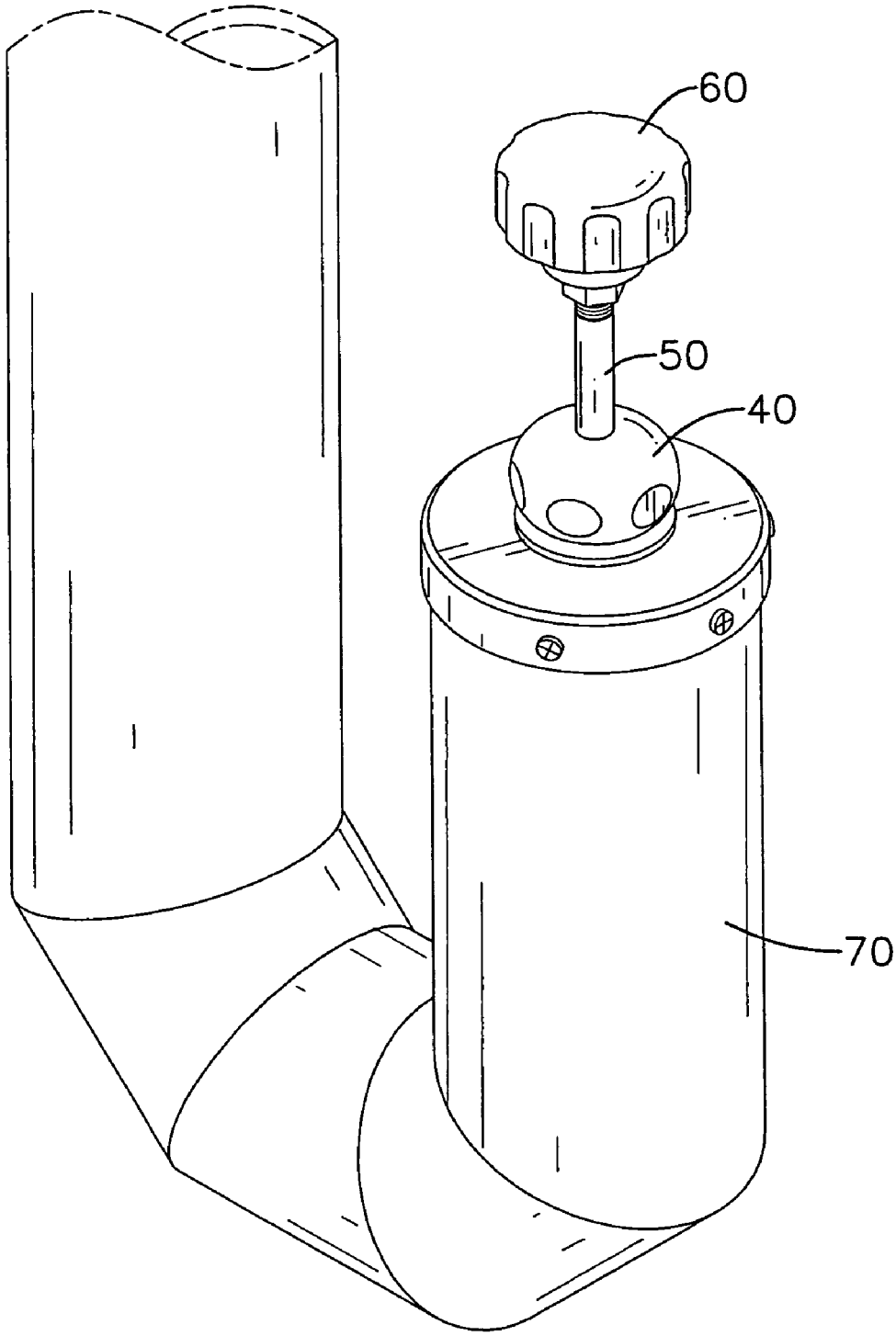
FIG. 5 is an operational view showing that the plug assembly of the present invention is employed to a resonator of a xylophone.

With reference to FIG. 5, whenever there is a need for tune adjustment when the plug assembly of the present invention is employed inside the resonator (70) of a xylophone, the user only needs to loosen the controlling nut (40) to loose the connection of the clamping element (42) to the outer periphery of the threaded rod (50), the user is then able to hold the knob (60) to adjust the position of the annular disk (10) inside the resonator (70). The tune adjustment is easily accomplished.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug assembly for a xylophone resonator, the plug assembly comprising:

a cover adapted to be mounted on the xylophone resonator to close an opening of the xylophone resonator;

an annular disk adapted to be received inside the xylophone resonator; and a threaded rod having a threaded bottom end extending through the cover to securely and threadingly connect to the annular disk, the threaded rod being selectively movable relative to the cover such that position of the annular disk inside the xylophone resonator is adjusted.

2. The plug assembly as claimed in claim 1, wherein the annular disk has multiple annular grooves defined in an outer side face of the annular disk and receiving therein sealing rings.

3. The plug assembly as claimed in claim 2, wherein the threaded rod extends through a joint having a first threaded connection portion which extends through the cover to threadingly engage with a cover securing nut and a second threaded connection portion integrally formed with the first threaded connection portion and extending upward from the cover to threadingly connect to a controlling nut with a clamping element received therebetween and surrounding an outer periphery of the threaded rod such that when the controlling nut is firmly connected to the second threaded connection portion, the clamping element is firmly engaged with the outer periphery of the threaded rod to position the threaded rod relative to the cover and the threaded rod is immovable relative to the cover and when the controlling nut is rotated to loosen the engagement of the clamping element to the outer periphery of the threaded rod, the threaded rod is able to move relative to the cover and the annular disk is movable relative to the cover.

4. The plug assembly as claimed in claim 3, wherein the controlling nut has a conical face formed inside the controlling nut, the conical face abuts a top end of the clamping element such that when the controlling nut is rotated to move closer to the second threaded connection portion, the clamping element is forced to firmly engage with the outer periphery of the threaded rod to stop the threaded rod from movement relative to the cover and when the controlling nut is rotated to move away from the second threaded connection portion, the threaded rod is movable relative to the cover.

5. The plug assembly as claimed in claim 4, wherein the second threaded connection portion has a recessed supporting face, the recessed supporting face is provided to receive therein the clamping element.

6. The plug assembly as claimed in claim 1, wherein the threaded rod has a top end to engage with a knob.

7. The plug assembly as claimed in claim 2, wherein the threaded rod has a top end to engage with a knob.

8. The plug assembly as claimed in claim 3, wherein the threaded rod has a top end to engage with a knob.

9. The plug assembly as claimed in claim 4, wherein the threaded rod has a top end to engage with a knob.

10. The plug assembly as claimed in claim 5, wherein the threaded rod has a top end to engage with a knob.

* * * * *